US007836663B2

(12) United States Patent
Solomon et al.

(10) Patent No.: US 7,836,663 B2
(45) Date of Patent: Nov. 23, 2010

(54) POLY-BONDED FRAMED PANELS

(75) Inventors: Fred L. Solomon, Gulfport, FL (US); William J. Harrington, Munster, IN (US)

(73) Assignee: Platinum Advanced Technologies, Inc., St. Petersburg, FL (US)

( * ) Notice: Subject to any disclaimer, the term of this patent is extended or adjusted under 35 U.S.C. 154(b) by 0 days.

(21) Appl. No.: 11/350,741

(22) Filed: Feb. 10, 2006

(65) Prior Publication Data

US 2007/0033890 A1 Feb. 15, 2007

Related U.S. Application Data

(63) Continuation-in-part of application No. 11/201,156, filed on Aug. 11, 2005, now Pat. No. 7,621,101.

(51) Int. Cl.
*E04C 2/00* (2006.01)

(52) U.S. Cl. ..... 52/782.1; 52/784.15

(58) Field of Classification Search ..... 52/309, 52/309.4, 309.14, 309.15, 799.1, 784.14, 52/463; 428/304.4, 44, 317.9, 306.6, 308.4, 428/297.4, 297.7; 442/30, 55, 221, 226, 442/315, 370, 374

See application file for complete search history.

(56) References Cited

U.S. PATENT DOCUMENTS

| | | | | | |
|---|---|---|---|---|---|
| 3,507,738 | A | | 4/1970 | Prusinski | |
| 4,471,591 | A | | 9/1984 | Jamison | 52/309.9 |
| 4,485,590 | A | * | 12/1984 | Legg et al. | 49/501 |
| 4,550,543 | A | | 11/1985 | Valenzano | 52/309.7 |
| 4,633,634 | A | * | 1/1987 | Nemmer et al. | 52/474 |
| 4,674,250 | A | | 6/1987 | Altizer | 52/309.7 |
| 4,712,352 | A | * | 12/1987 | Low | 52/794.1 |
| 4,758,460 | A | | 7/1988 | Spicer | |
| 4,981,003 | A | | 1/1991 | McCarthy | 52/309.7 |
| 5,133,140 | A | | 7/1992 | Frey | |
| 5,537,789 | A | * | 7/1996 | Minke et al. | 52/313 |
| 5,638,651 | A | | 6/1997 | Ford | 52/309.7 |
| 5,722,198 | A | * | 3/1998 | Bader | 52/745.09 |
| 5,893,248 | A | | 4/1999 | Béliveau | 52/309.7 |

(Continued)

OTHER PUBLICATIONS

Non-Final Office action dated Jan. 11, 2007 received in U.S. Appl. No. 11/201,156.

(Continued)

*Primary Examiner*—Richard E Chilcot, Jr.
*Assistant Examiner*—Jessica Laux
(74) *Attorney, Agent, or Firm*—Hanify & King, P.C.

(57) ABSTRACT

A one layer building panel derives its structural integrity from a foam forming the layer that bonds to horizontal and vertical stud members with a mesh material disposed therein. The vertical members can be provided at the edges of the building panel. The horizontal members can be provided at the edges of the building panel and together with the vertical member form a peripheral frame for the building panel. The foam is bonded to the horizontal and vertical stud members using above ambient temperatures and pressures. A mesh can be provided within the foam. A fiber reinforced layer can be provided on the interior and/or exterior surfaces of the foam. Building panels can be connected to one another to construct a building wall and ceiling using stud members having an interlocking capabilities. The building panels can be inserted into tracks secured to a floor using anchors.

17 Claims, 6 Drawing Sheets

U.S. PATENT DOCUMENTS

| | | | | |
|---|---|---|---|---|
| 6,044,603 | A * | 4/2000 | Bader | 52/309.7 |
| 6,119,422 | A * | 9/2000 | Clear et al. | 52/309.8 |
| 6,260,329 | B1 * | 7/2001 | Mills | 52/794.1 |
| 6,564,521 | B1 * | 5/2003 | Brown et al. | 52/309.11 |
| 2002/0137871 | A1 * | 9/2002 | Wheeler et al. | 528/44 |
| 2003/0113526 | A1 * | 6/2003 | Jaffee | 428/297.4 |
| 2004/0003559 | A1 * | 1/2004 | Minke et al. | 52/309.9 |
| 2005/0019549 | A1 * | 1/2005 | Tai et al. | 428/315.9 |
| 2005/0118369 | A1 * | 6/2005 | Kennedy | 428/35.7 |
| 2006/0265985 | A1 | 11/2006 | Nichols | |
| 2007/0039262 | A1 | 2/2007 | Forgy | |

OTHER PUBLICATIONS

Notice of Allowance dated Oct. 1, 2008 received in U.S. Appl. No. 11/201,156.

Supplemental Notice of Allowability dated Feb. 6, 2009 received in U.S. Appl. No. 11/201,156.

* cited by examiner

Fig. 1A
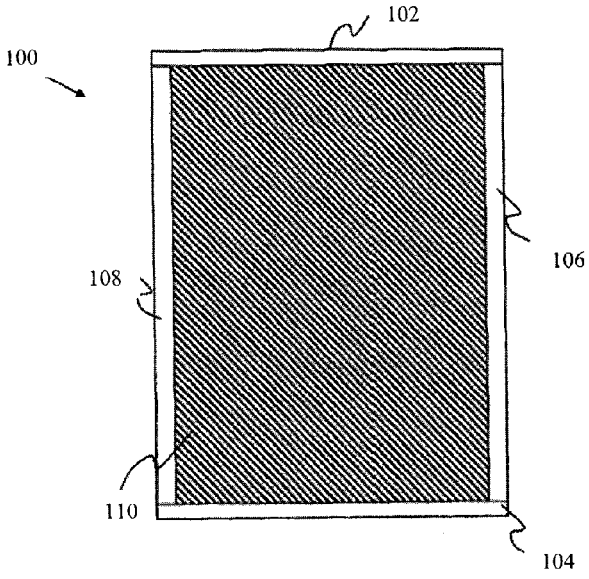
Fig. 1B
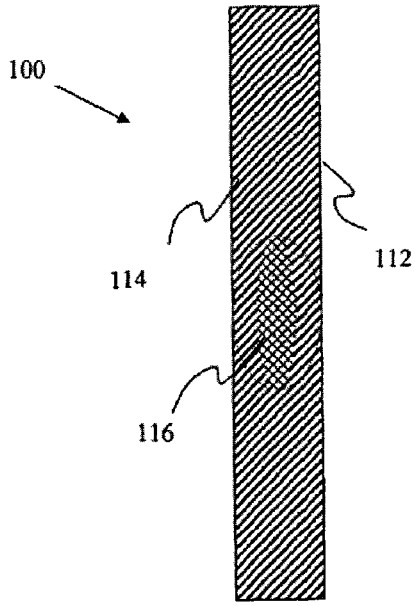
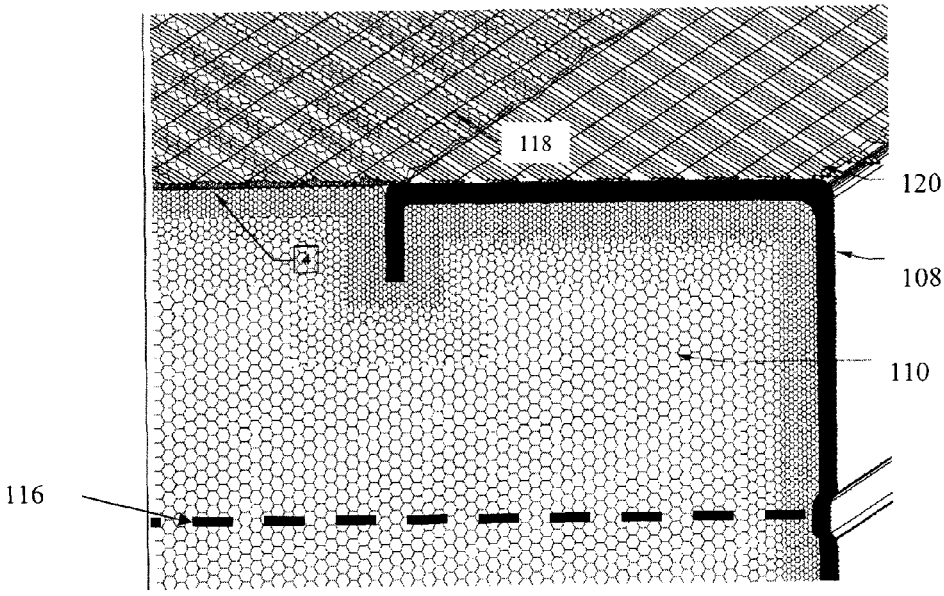
Fig. 1C

POLY-BONDED FRAMED PANELS

CROSS-REFERENCES TO RELATED APPLICATIONS

This is a continuation-in-part application taking priority from Ser. No. 11/201,156 filed on Aug. 11, 2005 now U.S. Pat. No. 7,621,101.

BACKGROUND OF THE INVENTION

1. Field of the Invention

The present invention relates to a building panel, method of fabricating the building panel, and method of constructing a build employing the building panel. More particularly, the present invention relates to a framed building panel, method of fabricating the framed building panel, and method of constructing a build employing the building panel, wherein the framed building panel has increase structural integrity and is operable to construct a wall, roof, floor, ceiling, room, and building.

2. Description of the Prior Art

The construction industry is continuously attempting to find ways to reduce the time, cost, and labor associated with the construction of a structure, such as a building, wall, room, floor, ceiling and roof. Techniques used to reduce the time, cost, and labor associated with the construction of a structure includes prefabrication of various portions of a structure. Once the portion of the structure is fabricated, it is then transported to the construction site for placement in its intended location. One problem with such techniques is that the prefabricated portion of the structure is constructed with conventional materials using the techniques that would be used on the construction site. Another problem with these techniques is that the prefabricated portion is subject to damage during its transportation to the construction site.

These techniques typically also require that the structural integrity of the prefabricated portion of the building is derived solely from the frame of the prefabricated portion. In some instances, the structural integrity of the prefabricated portion of the building and the building itself is further derived from the specific way a prefabricated portion needs to be assembled with another portion of the building using connections, fasteners, and other coupling mechanisms specific to using the prefabricated portion.

Accordingly, there is a need for a building panel having structural integrity, a method of fabricating the building panel having structural integrity, and method of constructing a building employing the building panel. There is a need for the building panel having structural integrity and the method of fabricating the building panel having structural integrity, where the structural integrity is derived from the bonding of the foam to vertically and horizontally aligned stud members. There is a need for the vertically and horizontally aligned studs to form a frame. There is a need for the foam to define an interior side of the building panel and an exterior side of the building panel. There is a need for the building panel having structural integrity to couple to another building panel having structural integrity. There is a need for the building panel to interlock with an adjacent building panel employing an interlocking stud. There is a need for the building panel to be held in an upright position employing a track secured to a floor, such as with an anchor.

SUMMARY OF THE INVENTION

According to an embodiment of the present invention, a building panel having structural integrity, a method of fabricating the building panel having structural integrity, and method of constructing a building employing the building panel are provided. The building panel is a one layer building panel that derives its structural integrity from a foam forming the layer that bonds to horizontal and vertical stud members. The vertical members can be provided at the edges of the building panel. The horizontal members can be provided at the edges of the building panel and together with the vertical member form a peripheral frame for the building panel. The foam is bonded to the horizontal and vertical stud members using above ambient temperatures and pressures. Building panels can be coupled to one another to construct a structure, such as a room, floor, level and roof, using vertical members at the edges having an interlocking capabilities. One or more building panels can be inserted into one or more tracks secured to a floor to hold the one or more building panels in an upright position.

According to an embodiment of the present invention, a building panel having structural integrity is provided. The building panel includes a peripheral frame having a top horizontal stud member, a bottom horizontal stud member, a left vertical stud member, and a right vertical stud member. A first end portion of the top horizontal stud member joins to a first end portion of left vertical stud member, a second end of the top horizontal stud member joins to a first end portion of right vertical stud member, a first end portion of the bottom horizontal stud member joins to a second end portion of left vertical stud member, and a second end portion of the bottom horizontal stud member joins to a second end of the right vertical stud member. A foam is formed at least within the peripheral frame, wherein the foam is bonded to the peripheral frame. A first side of the foam defines an exterior surface of the building panel, and a second side of the foam defines an interior surface of the building panel. Mesh is provided within the foam.

In an embodiment of the present invention, the structural integrity of the building panel is derived from the bonding of the foam to the peripheral frame.

In an embodiment of the present invention, the foam comprises a thermoplastic material or a thermoset material.

In an embodiment of the present invention, the top horizontal stud member, the bottom horizontal stud member, the right vertical stud member, and the left vertical stud member are constructed from one of: metal, aluminum, wood, and plastic.

In an embodiment of the present invention, the top horizontal stud member, the bottom horizontal stud member, the right vertical stud member, and the left vertical stud member are configured as one of: a convention stud, a c-shaped stud, and an interlocking stud.

In an embodiment of the present invention, a first side of the foam defines an exterior surface of the building panel and a second side of the foam defines an interior surface of the building panel.

In an embodiment of the present invention, a fiber reinforced surface layer is applied to the exterior surface of the building panel.

In an embodiment of the present invention, a fiber reinforced surface layer is applied to the interior of the building panel.

In an embodiment of the present invention, the foam and the mesh extends to the outer boundary of the peripheral frame.

In an embodiment of the present invention, at least one of the right vertical stud member, the left vertical stud member, top horizontal stud member, and bottom vertical stud member is an interlocking stud operable to interlock with an interlocking stud of an adjacent structural component.

According to an embodiment of the present invention, an interlocking stud to guide to edge of a first building panel into a receiving edge of another building is provided.

In an embodiment of the present invention, a structural component couples to the interlocking stud within the first side wall and second side wall.

In an embodiment of the present invention, the interlocking stud is operable to interlock with another interlocking stud.

According to an embodiment of the present invention, an improved modular building is provided. The building includes a first set of building panels defining a perimeter of the modular building, wherein each of the building panels include a peripheral frame having a top horizontal stud member, a bottom horizontal stud member, a left vertical stud member, and a right vertical stud member. A first end portion of the top horizontal stud member joins to a first end portion of left vertical stud member. A second end of the top horizontal stud member joins to a first end portion of right vertical stud member. A first end portion of the bottom horizontal stud member joins to a second end portion of left vertical stud member. A second end portion of the bottom horizontal stud member joins to a second end of the right vertical stud member. A foam formed at least within the peripheral frame is bonded to the peripheral frame. A first side of the foam defines an exterior surface of the building panel, and a second side of the foam defines an interior surface of the building panel. Each of the building panels configured with an interlocking stud as the left vertical stud member and the right vertical stud member for interlocking with an adjacent building panel configured with an interlocking stud as the left vertical stud member and the right vertical stud member. A covering is supported by, and secured to, the set of building panels.

In an embodiment of the present invention, the covering is constructed from a second set of building panels.

In an embodiment of the present invention, tracks includes a base portion, a first track sidewall, and a second track sidewall and is anchored to a foundation of the modular building with a set of anchors including, but not limited to, anchor bolts or other similar methods.

In an embodiment of the present invention, an anchor is inserted through a hole receptive in the base portion of a track into the foundation and a top portion of the anchor engages the base portion of the track and the base portion of the track engages the foundation.

According to an embodiment of the present invention, A system for securing a wall of a building to a foundation is provided. The system includes a track including a base portion, a first track sidewall, and a second track sidewall and an anchor each having a J-shape configuration.

BRIEF DESCRIPTION OF THE DRAWINGS

The above described features and advantages of the present invention will be more fully appreciated with reference to the detailed description and appended figures in which:

FIGS. 1A-1B depict exemplary diagrams of a building panel having structural integrity according to an embodiment of the present invention;

FIG. 1C depicts an exemplary top view of a c-shaped stud with foam and mesh according to an embodiment of the present invention;

DETAILED DESCRIPTION OF THE INVENTION

Figure 2:
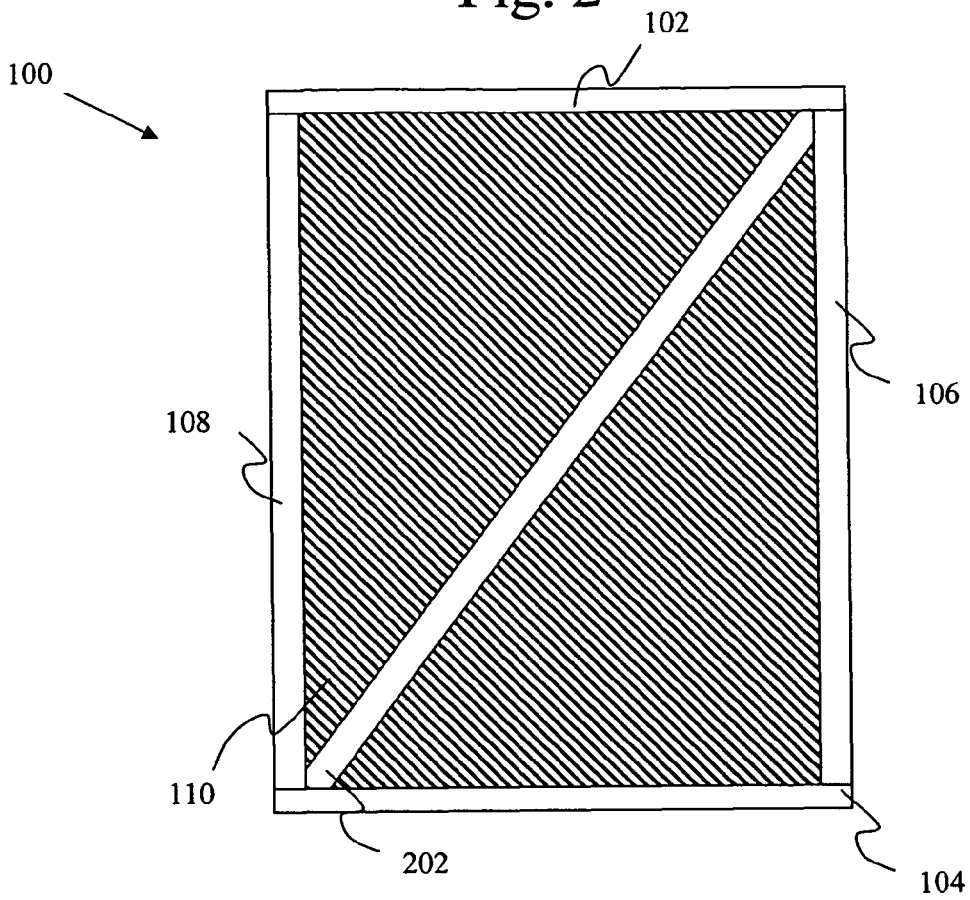
FIG. 2 depicts an exemplary diagram of a building panel with a diagonal stud member having structural integrity according to an embodiment of the present invention.

The present invention is now described more fully hereinafter with reference to the accompanying drawings that show embodiments of the present invention. The present invention, however, may be embodied in many different forms and should not be construed as limited to embodiments set forth herein. Appropriately, these embodiments are provided so that this disclosure will be thorough and complete, and will fully convey the scope of the present invention.

According to an embodiment of the present invention, a building panel having structural integrity, a method of fabricating the building panel having structural integrity and method of constructing a building employing the building panel are provided. The building panel is a one layer building panel that derives its structural integrity from a foam forming the layer that bonds to horizontal and vertical stud members. The vertical stud members can be provided at the edges of the building panel. The horizontal stud members can be provided at the edges of the building panel and together with the vertical stud member form a peripheral frame for the building panel. The foam is bonded to the horizontal and vertical stud members using temperatures and pressures above ambient. Building panels can be coupled to one another to construct a structure, such as a room, floor, level and roof, using vertical and horizontal stud members at the edges having an interlocking capabilities. One or more building panels can be inserted into one or more tracks secured to a floor to hold the one or more building panels in an upright position.

Exemplary diagrams of a building panel having structural integrity according to an embodiment of the present invention are shown in FIGS. 1A-1B. In the embodiment of FIG. 1A, building panel 100 includes a top horizontal stud member 102, a bottom horizontal stud member 104, a right vertical stud member 106, a left vertical stud member 108, and a foam member 110. The building panel of FIG. 1A includes an exterior panel side 112, an interior panel side 114, and a mesh member 116 positioned within foam member 110 as shown in FIG. 1B. In the FIG. 1A embodiment of the present invention, the top horizontal stud member 102, bottom horizontal stud member 104, right vertical stud member 106, and left vertical stud member 108 can be constructed from one of metal, aluminum, wood and plastic. In an embodiment of the present invention, a stud member, such as top horizontal stud member 102, bottom horizontal stud member 104, right vertical stud member 106, and/or left vertical stud member 108, can be configured as a conventional stud, a c-shaped stud, an interlocking stud, or the like. In an embodiment of the present invention, the foam member 110 forms around the c-shaped stud members to provide increase structural integrity and mesh member 116 couples to c-shaped stud member as shown in FIG. 1C. In an embodiment of the present invention, the mesh member 116 is provided within the foam member 110. In an embodiment of the present invention, the mesh can span the extent of the foam member 110 and couple to each of the top horizontal stud member 102, bottom horizontal stud member 104, right vertical stud member 106, and left vertical stud member 108. In an embodiment of the present invention, a set of mesh members can be provided within the foam member 110 and extend from the top horizontal stud member 102 to the bottom horizontal stud member 104. In an embodiment of the present invention, a set of mesh members can be provided within the foam member 110 and extend from the left vertical stud member 108 to the right vertical stud member 106.

The mesh member 116 can be configured from materials including, but not limited to, aluminum, steal, copper, and plastic. In an embodiment of the present invention, the mesh size can be from 2 Mesh to 325 Mesh which means the number of meshes per lineal inch of material. In an embodiment of the present invention, the mesh size can be 5 Mesh to 300 Mesh. In an embodiment of the present invention gauge of the mesh can be from 50 gauge to 10 gauge. In another embodiment, the mesh has a gauge ranging from 40 to 10. In an embodiment of the present invention, the mesh has a gauge ranging from 30 to 15.

In an embodiment of the present invention, a surface of foam member 110 can be provided with a fiber reinforced surface layer 118 as shown in FIG. 1C. The fiber can be made from any material that strengthens the impact level of the panel member 100. The material can be, but is not limited to, Fiberglass, Aramid, Carbon and Natural fibers. In an embodiment of the present invention, the weight per square yard of the fiber can range from 12 oz. to 300 oz. In an embodiment of the present invention, the weight per square yard of the fiber can range from 12 oz. to 100 oz. In an embodiment of the present invention, the weight per square yard of the fiber can range from 75 oz. to 200 oz. In an embodiment of the present invention, the weight per square yard of the fiber can range from 125 oz. to 300 oz. The orientation of the fibers with respect to the longitudinal axis of the panel surface can be 0, +/−5, +/−10, +/−15, +/−30, +/−45, +/−60 and +/−90 degrees or any angle in between. The fiber layers can be either stitch bonded or woven together to form multiple ply cloths 120, as shown in FIG. 1C, which are utilized in the production of the panels.

In the FIG. 1A embodiment of the present invention, top horizontal stud member 102 and bottom horizontal stud member 104 are axially aligned and positioned at the upper and lower periphery of building panel 100 to form the top and bottom of building panel 100. In an embodiment of the present invention, top horizontal stud member 102 and bottom horizontal stud member 104 are axially align and positioned at a predetermined distance from one another. In the FIG. 1A embodiment of the present invention, right vertical stud member 106 and left vertical stud member 108 are axially aligned and positioned at the left and right periphery of building panel 100 to form the left side and right side of building panel 100. In an embodiment of the present invention, left vertical stud member 108 and right vertical stud member 106 are axially aligned and positioned at a predetermined distance from one another. In an embodiment of the present invention, the vertical stud members 106 and 108 extend the height of the building panel 100 and the horizontal stud members 102 and 104 extend the length of the building panel 100. In an embodiment of the present invention, the vertical stud members 106 and 108 of building panel 100 are configured to interlock with a vertical stud member of an adjacent building panel 100 to form a wall or room. In an embodiment of the present invention, the horizontal stud members 102 and 104 are configured to interlock with the interlocking stud members of building panels used to form a ceiling, roof, or floor of a structure. The building panel can be secured to a floor member to hold the building panel in an upright position by methods including, but not limited to, slots in the foundation or direct fixation with screws, welds or adhesives.

In the FIG. 1A embodiment of the present invention, the top horizontal stud member 102, bottom horizontal stud member 104, right vertical stud member 106, and left vertical stud member 108 form a frame around panel member 110. In the FIG. 1A embodiment of the present invention, a first end portion of the top horizontal stud member 102 squarely abuts a first end portion of left vertical stud member 108. In the FIG. 1A embodiment of the present invention, a second end of the top horizontal stud member 102 squarely abuts a first end portion of right vertical stud member 106. In the FIG. 1A embodiment of the present invention, a first end portion of the bottom horizontal stud member 104 squarely abuts a second end portion of left vertical stud member 108. In the FIG. 1A embodiment of the present invention, a second end portion of the bottom horizontal stud member 104 squarely abuts a second end of right vertical stud member 106. In an embodiment of the present invention, the members can be coupled, such as by screws, welding, adhesive and bolts, at the points of abutment to further provide structural integrity.

In the FIG. 1A embodiment of the present invention, panel member 110 extends and bonds to the inner side of each of the top horizontal stud member 102, bottom horizontal stud member 104, right vertical stud member 106, and left vertical stud member 108. In the FIG. 1A embodiment of the present invention, the thickness of the panel member 110 is substantially the same as the width of the top horizontal stud member 102, bottom horizontal stud member 104, right vertical stud member 106, and left vertical stud member 108. The front side and back side of the foam member 110 defines the exterior and interior of building panel 100. In an embodiment of the present invention, building panel 100 conforms to chapter 26 of the International building code for requirements including, but not limited to, flame spread and smoke spread.

In an embodiment of the present invention, panel member 110 extends to the outer side of each of the top horizontal stud member 102, bottom horizontal stud member 104, right vertical stud member 106, and left vertical stud member 108 and bonds to the back, front, and inner sides of each of the top horizontal stud member 102, bottom horizontal stud member 104, right vertical stud member 106, and left vertical stud member 108. In an embodiment of the present invention, the panel member 110 thickness extends beyond the width of each of the top horizontal stud member 102, bottom horizontal stud member 104, right vertical stud member 106, and left vertical stud member 108. In an embodiment of the present invention, the front side and back side of the foam member 110 defines the exterior and interior of building panel 100 as well as the exterior and interior of a wall, roof, or ceiling for a structure constructed with building panel 100.

An exemplary embodiment of the building panel 100 of FIGS. 1A-1B is shown in FIG. 2 with a diagonal stud member. In the FIG. 2 embodiment of the present invention, diagonal stud member 202 can be constructed from one of metal, aluminum, wood and plastic. In the FIG. 2 embodiment of the present invention, a first end portion of the diagonal stud member 202 abuts to a second end portion of the top horizontal stud member 102 and a first end portion of right vertical stud member 106. In the FIG. 2 embodiment of the present invention, a second end portion of the diagonal stud member 202 abuts a first end portion of the bottom horizontal stud member 104 squarely and second end portion of left vertical stud member 108. In the FIG. 2 embodiment of the present invention, panel member 110 extends and bonds to the inner side of each of the top horizontal stud member 102, bottom horizontal stud member 104, right vertical stud member 106, and left vertical stud member 108 as well as the right and left side of diagonal stud member 202. In an embodiment of the present invention, the members can be coupled at the points of abutment to further provide structural integrity.

Figure 3:
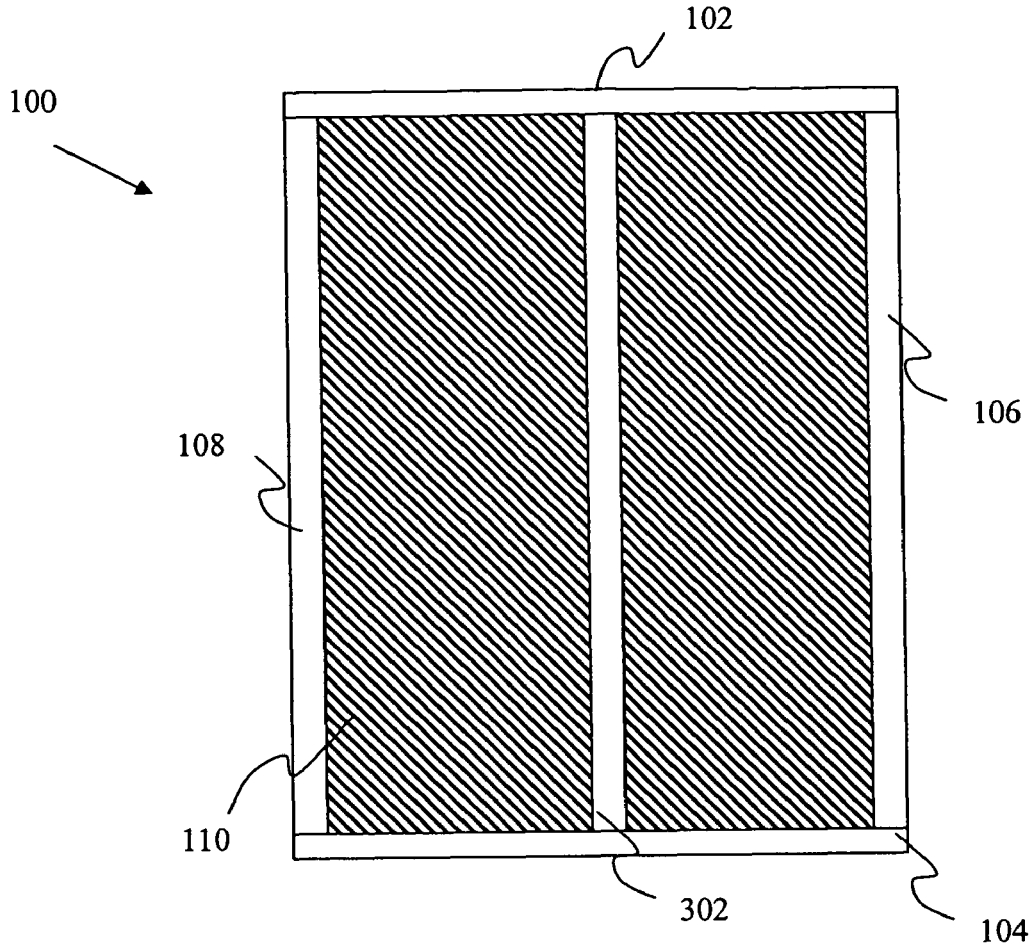
FIG. 3 depicts an exemplary diagram of a building panel with an inner vertical stud member having structural integrity according to an embodiment of the present invention.

An exemplary embodiment of the building panel 100 of FIGS. 1A-1B is shown in FIG. 3 with an inner vertical stud member. In the FIG. 3 embodiment of the present invention, an inner vertical stud member 302 can be constructed from one of metal, aluminum, wood and plastic. In the FIG. 3 embodiment of the present invention, a fist end portion of an inner vertical stud member 302 squarely abuts the top horizontal stud member 102 and a second end of the inner vertical stud member 302 squarely abut the bottom horizontal stud member 104. In the FIG. 3 embodiment of the present invention, panel member 110 extends and bonds to the inner side of each of the top horizontal stud member 102, bottom horizontal stud member 104, right vertical stud member 106, and left vertical stud member 108 as well as the right and left side of inner vertical stud member 106. In an embodiment of the present invention, the members can be coupled at the points of abutment to further provide structural integrity. In an embodiment of the present invention, inner stud members can be configured to define openings for doors, windows, and the like.

Figure 4:
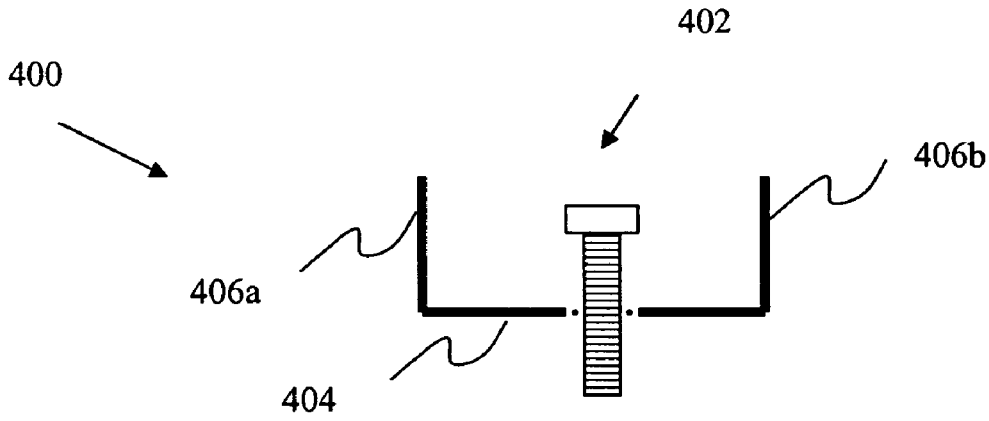
FIG. 4 depicts an exemplary diagram of an anchor and track according to an embodiment of the present invention.

An exemplary side view of an anchor and track is shown in FIG. 4. In the FIG. 4 embodiment of the present invention, the track 400 has a C-shaped configuration having a base and two sidewalls projecting upward from the base, which can be secured to a floor at the side of base opposite the sidewalls using one or more anchors. In an embodiment of the present invention, the track 400 can be used to hold one or more wall structures, such as a building panel 100, in an upright position between the sidewalls. The track 400 can be constructed from one of metal, aluminum, and the like. In an embodiment of the present invention, the track can be secured to a floor using an anchor 402 including, but not limited to, one or a combination of screws, bolts, welds, anchors, adhesive, and the like. The anchor 402 can be constructed from one of metal, steel, and the like. In an embodiment of the present invention, the floor is pre-dried concrete and the base of the track 400 meets with a pre-dried concrete floor. Once the concrete dries, the track 400 and anchor are securely fastened to the concrete floor.

Figure 5:
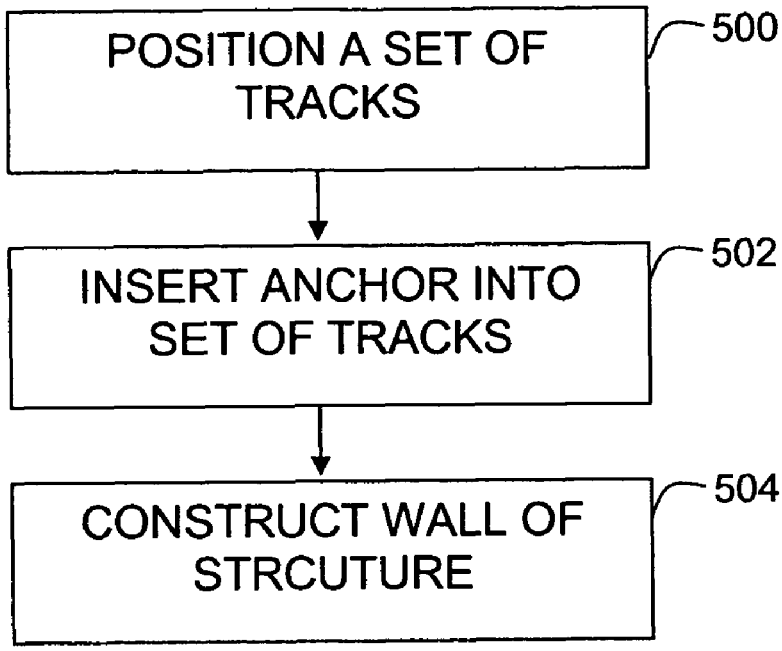
FIG. 5 depicts an exemplary flow chart of a method for constructing a structure using a set of building panels according to an embodiment of the present invention.

An exemplary flow chart of a method of constructing a structure using the building panels, anchor and track, and interlocking stud member is shown in FIG. 5. The type of structure includes, but are not limited to, a wall, roof, room, home, commercial building, strip mall, cold storage facility, and apartment building. The method begins with step 500. In step 500, a set of tracks is positioned in a configuration to define the outer boundaries of a building. In step, 502, anchors are inserted through holes in the tracks and into the floor that the tracks sit on. In an embodiment of the present invention, the floor is concrete. In step 504, the walls of the structure are constructed. In the FIG. 5 embodiment of the present invention, construction of a wall includes, inserting a set of building panels within the sidewalls of the track and interlocking the interlocking stud members of adjacent building panels. To inserting a building panel within the sidewalls of the track, the building panel can be lifted over the sidewalls of the track. Interlocking the interlocking stud of the building panel to the interlocking stud of an adjacent building panel is performed prior to inserting the building panel into the track. The interlocking of interlocking studs and insertion of interlocked building panels into the track secures the interlocked building panels to one another in an upright position. A ceiling constructed from the building panels can be secured to a wall constructed of the ceiling panels employing an eave lock, wherein the eave lock has a base portion and a pair of sidewall, each sidewall being angled away from the base portion.

Figure 6:
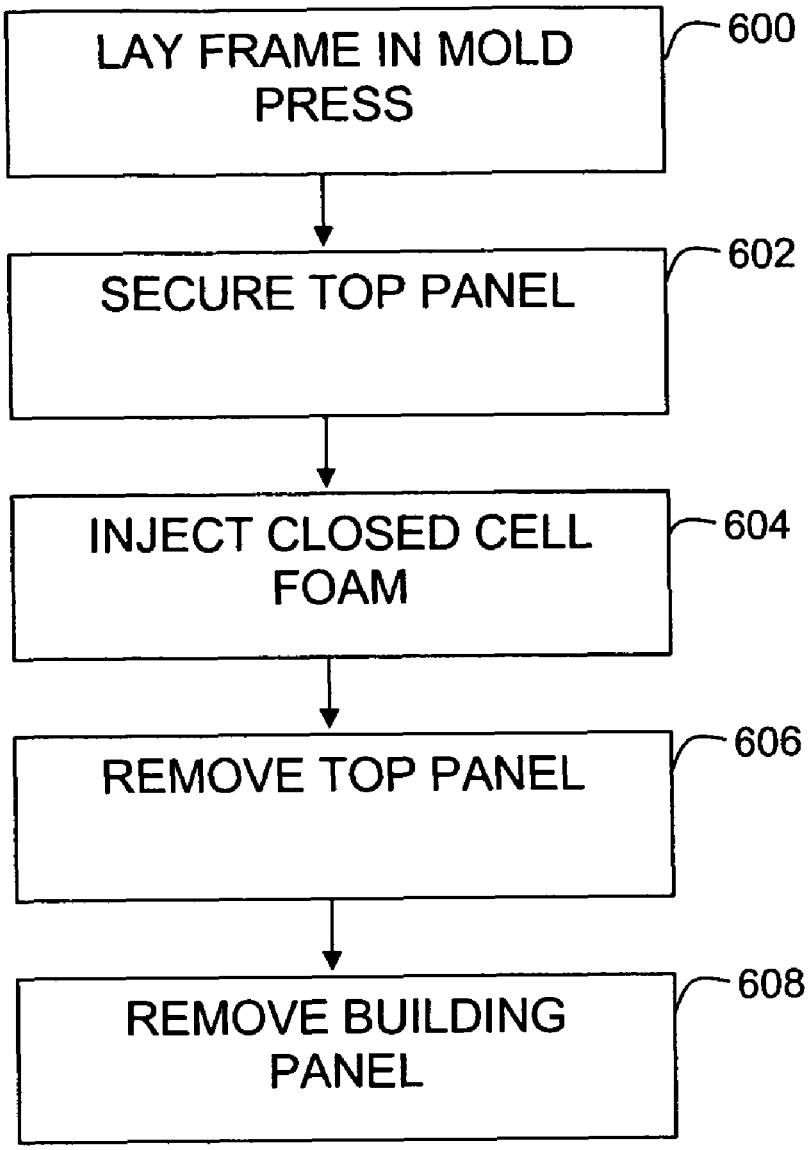
FIG. 6 depicts an exemplary flow chart of a method of fabricating the building panel shown in FIG. 1.

An exemplary flow chart of a method of fabricating the building panel of FIG. 1 is shown in FIG. 6. The method begins in step 600. In step 600, a peripheral frame of stud members is placed in a mold press. In an embodiment of the present invention, the mold press includes an enclosure having a top panel, sidewalls and a bottom panel. In an embodiment of the present invention, a mesh is coupled to the peripheral frame. In an embodiment of the present invention, a mesh is suspended within the peripheral frame. In an embodiment of the present invention, dry fiber 120 as shown in FIG. 1C is laid on the bottom panel and/or provided on the top panel of the mold press. Once the foam is injected into the mold press the fiber is impregnated with the foam.

In step 602, the top panel is placed on, and secured to the sidewalls. In an embodiment of the present invention, the top panel is secured to the sidewalls with sufficient strength to sustain pressures achieved by the mold press. In one embodiment, the studs and/or mesh can be surface treated for improved bonding. Surface treatment can be effected by any of the several techniques known in the art, such as corona discharge, plasma treatment, ozone treatment, sand blasting, brush tumbling, and the like. Preferably, surface treatment is effected by grinding with an abrasive wheel. As will be appreciated by those of ordinary skill in the art, the effect of the surface treatment can vary based on the type of material used to fabricate the stud and/or mesh. For example, a metal stud can be subjected to sand blasting in order to increase the adhesion between the metal stud and the foam material.

In an alternate embodiment, a metal stud can be pretreated with a plasma thermal spray coating thus taking advantage of the ability of plasma technology to excite gas atoms and molecules into transient and nonequilibrium conditions. An enclosed vacuum chamber can be used to excite the gas molecules by subjecting the gas mixture to an electrified field of radio frequency (rf) energy. In the alternative, the plasma technology can be performed under atmospheric pressure and ambient temperature, without the use of vacuum equipment. The oxygen functionalities created on the surfaces are chemically reactive and permanent and allow the foam material to form a covalent bond to the modified surface.

In step 604, a foam is injected and distributed consistently into the mold press. In an embodiment of the present invention, the foam is injected within, and bonded to, the peripheral frame. In an embodiment of the present invention, the foam is injected within, over, and bonded to, the frame. In an embodiment of the present invention, the foam has a thickness substantial equivalent to the thickness of the stud members of the peripheral frame. In an embodiment of the present invention, the foam has a thickness to substantially cover the stud members of the peripheral frame.

In the FIG. 6 embodiment of the present invention, the press can be maintained above-ambient pressure, where the pressure is directly related to the density of the foam. In an embodiment of the present invention, the density of the foam can be based on the specific application that the building panel is going to be used. Any suitable temperature and pressure can be provided that allows the reaction to proceed. For example, the temperature may range from about 32° F. to about 180° F. In one embodiment, the reaction temperature is about 75° F. to about 170° F. In another embodiment, the reaction occurs at a temperature of about 75° F. to about 150° F. In yet another embodiment, the reaction occurs at a temperature of about 80° F. to about 85° F. The pressure may range from about 1 psi to about 15 psi. In one embodiment of the present invention, the pressure is about 3 psi to about 10 psi. In another embodiment of the present invention, the reaction occurs under a pressure of about 5 psi to about 7 psi.

The foam can be any suitable foam material that is capable of being injected and distributed consistently within the peripheral frame. For example, the foam material may be a thermoset material or a thermoplastic material. The foam may include, but is not limited to, polystyrene, polyurethane, polyurea, polyisocyanurate, and the like. In one embodiment, the material is a molded expanded polystyrene foam. In another embodiment, the material is an extruded expanded polystyrene foam.

In still another embodiment, polyurethane foam is used. The polyurethane foam may be a single-component polyurethane, where the main components (isocyanate and a hydroxy-terminated component) are stored together as a blended mix, accompanied by a blowing agent in liquid form, and catalyzed to cure when exposed to moisture in the air. On release from their pressurized container, the two main components react chemically, and the heat from this reaction causes the blowing agent to convert into a gas and expand to form the cellular structure of the foam. When the reaction is complete, the gas is trapped within the material. In two-component polyurethane, the same two main ingredients and appropriate catalysts are kept apart until application. The chemical reaction when they are combined is much faster than with one-component foam. Curing is chemical, requires no air or moisture, and is independent of the surrounding environment. As an alternative, polyiscyanurate foam may be used for improved fire-resistance and higher R-values as compared to polyurethane foam.

In yet another embodiment, the foam material includes polyurea linkages and may be prepared by reacting an isocyanate with an amine-terminated component. Whether the foam includes urethane or urethane linkages, the foam may be the result of a one-shot method or a prepolymer method. Those of ordinary skill in the art will appreciate that the different methods have advantages and disadvantages depending on the application.

Any isocyanate available to one of ordinary skill in the art is suitable for use according to the invention. Isocyanates for use with the present invention include aliphatic, cycloaliphatic, araliphatic, aromatic, any derivatives thereof, and combinations of these compounds having two or more isocyanate (NCO) groups per molecule. Suitable isocyanate-containing components include diisocyanates having the generic structure: O═C═N—R—N═C═O, where R is preferably a cyclic, aromatic, or linear or branched hydrocarbon moiety containing from about 1 to about 20 carbon atoms.

Suitable hydroxy-terminated components include, but are not limited to, polyols including polyether polyols, polycaprolactone polyols, polyester polyols, polycarbonate polyols, hydrocarbon polyols, and mixtures thereof. Both saturated and unsaturated polyols are suitable for use with the present invention. Non-limiting examples of amine-terminated compounds for use with the present invention include amine-terminated hydrocarbons, amine-terminated polyethers, amine-terminated polyesters, amine-terminated polycarbonates, amine-terminated polycaprolactones, and mixtures thereof. The amine-terminated segments may be in the form of a primary amine ($NH_2$) or a secondary amine (NHR).

If the prepolymer method is used to form a polyurethane or polyurea-based material, the curing agent may include hydroxy-terminated curing agents, amine-terminated curing agents, and mixtures thereof. For example, any of the hydroxy-terminated compounds or amine-terminated compounds discussed above are also suitable for use as a curative.

As known to those of ordinary skill in the art, aliphatic or saturated components, i.e., components that do not include C═C or aromatic rings, produce foam materials that are less susceptible to ultraviolet light. As such, in one embodiment (when applicable), the foam includes only aliphatic components to result in a non-yellowing product. This embodiment is especially useful when the panels are intended to be left unpainted once installed.

Foaming of the material of the invention may occur through the addition of at least one physical or chemical blowing or foaming agent. Suitable blowing or foaming agents include, but are not limited to, organic blowing agents, such as azobisformamide; azobisisobutyronitrile; diazoaminobenzene; N,N-dimethyl-N,N-dinitrosoterephthalamide; N,N-dinitrosopentamethylene-tetramine; benzenesulfonylhydrazide; benzene-1,3-disulfonyl hydrazide; diphenylsulfon-3-3, disulfonyl hydrazide; 4,4'-oxybis benzene sulfonyl hydrazide; p-toluene sulfonyl semicarbizide; barium azodicarboxylate; butylamine nitrile; nitroureas; trihydrazino triazine; phenyl-methyl-uranthan; p-sulfonhydrazide; peroxides; and inorganic blowing agents such as ammonium bicarbonate and sodium bicarbonate.

In another embodiment, the material is foamed forcing a pressurized gas, such as nitrogen or carbon dioxide, into the polymerizing mixture. In another embodiment, the material is foamed by blending microspheres with the composition either during or before the molding process. Polymeric, ceramic, metal, and glass microspheres are useful in the invention, and may be solid or hollow and filled or unfilled.

The foamed material may be closed-cell or open-cell, however, as known to those of ordinary skill in the art, a closed-cell foam material forms a hydrophobic top skin. As such, if the material of the invention is initially an open-cell foam, a subsequent sealant is preferred to add hydrophobicity to the cured material.

In step 606, the top panel of the mold press is removed. In step 708, the building panel is removed from the mold press.

While specific embodiments of the present invention have been illustrated and described, it will be understood by those having ordinary skill in the art that changes can be made to those embodiments without departing from the spirit and scope of the invention.

We claim:

1. A building panel including studs used in construction, comprising:

a peripheral frame configured with the studs, wherein the studs include a top horizontal stud member, a bottom horizontal stud member, a left vertical stud member, and aright vertical stud member, wherein a first end portion of the top horizontal stud member joins to a first end portion of left vertical stud member, a second end of the top horizontal stud member joins to a first end portion of right vertical stud member, a first end portion of the bottom horizontal stud member joins to a second end portion of left vertical stud member, and a second end portion of the bottom horizontal stud member joins to a second end of the right vertical stud member;

a foam formed at least within the peripheral frame, wherein the foam is bonded to the peripheral frame, and wherein the foam consists essentially of a material selected from the group consisting of polystyrene, polyurethane, polyurea, and polyisocyanurate; and a woven material disposed on only a first side of the foam, wherein the woven material consists essentially of a fiber stitch bonded together.

2. The building panel of claim 1, wherein the structural integrity of the building panel is derived from the bonding of the foam to the peripheral frame.

3. The building panel of claim 1, wherein the foam is a thermoplastic or a thermoset polyurethane.

4. The building panel of claim 1, wherein the top horizontal stud member, the bottom horizontal stud member, the right vertical stud member, and the left vertical stud member are constructed from one of: metal, aluminum, wood, and plastic.

5. The building panel of claim 1, wherein the top horizontal stud member, the bottom horizontal stud member, the right vertical stud member, and the left vertical stud member are configured as one of: a convention stud, and a c-shaped stud.

6. The building panel of claim 1, wherein the first side of the foam defines an exterior surface of the building panel.

7. The building panel of claim 6, further comprising a mesh provided within the foam.

8. The building panel of claim 7, wherein the foam and the mesh extends to the outer boundary of the peripheral frame.

9. The building panel of claim 6, wherein a second side of the foam defines an interior surface of the building panel.

10. The building panel of claim 1, wherein the foam has a thickness substantially equivalent to a thickness of studs.

11. The building panel of claim 1, wherein the foam has a thickness to substantially cover the studs.

12. The building panel of claim 1, wherein the fiber is selected from the group consisting of Fiberglass, Aramid, Carbon and Natural fibers.

13. A building panel comprising:

a peripheral frame configured with a plurality of studs, wherein the plurality of studs comprise:

a top horizontal stud member;

a bottom horizontal stud member;

a left vertical stud member; and a right vertical stud member, wherein a first end portion of the top horizontal stud member joins to a first end portion of left vertical stud member, a second end of the top horizontal stud member joins to a first end portion of right vertical stud member, a first end portion of the bottom horizontal stud member joins to a second end portion of left vertical stud member, and a second end portion of the bottom horizontal stud member joins to a second end of the right vertical stud member;

a foam insert at least within the peripheral frame comprising:

a foamed layer having a front side and a back side and formed from a material consisting essentially of polystyrene, polyurethane, polyurea, and polyisocyanurate; and a woven material disposed onto the front side of the foamed layer to define an exterior surface of the building panel, wherein the woven material consists essentially of a fiber stitch bonded together.

14. The building panel of claim 13, wherein the material is a thermoplastic or thermoset polyurethane.

15. The building panel of claim 13, wherein the fiber is selected from the group consisting of Fiberglass, Aramid, Carbon and Natural fibers.

16. A building panel comprising:

a peripheral frame configured with the studs, wherein the studs include a top horizontal stud member, a bottom horizontal stud member, a left vertical stud member, and a right vertical stud member, wherein a first end portion of the top horizontal stud member joins to a first end portion of left vertical stud member, a second end of the top horizontal stud member joins to a first end portion of right vertical stud member, a first end portion of the bottom horizontal stud member joins to a second end portion of left vertical stud member, and a second end portion of the bottom horizontal stud member joins to a second end of the right vertical stud member;

a polyurethane foam formed at least within the peripheral frame, wherein the foam is bonded to the peripheral frame; and a woven material disposed on a first side of the polyurethane foam, wherein the woven material consists essentially of fiber stitch bonded together.

17. A building panel comprising:

a peripheral frame configured with the studs, wherein the studs include a top horizontal stud member, a bottom horizontal stud member, a left vertical stud member, and a right vertical stud member, wherein a first end portion of the top horizontal stud member joins to a first end portion of left vertical stud member, a second end of the top horizontal stud member joins to a first end portion of right vertical stud member, a first end portion of the bottom horizontal stud member joins to a second end portion of left vertical stud member, and a second end portion of the bottom horizontal stud member joins to a second end of the right vertical stud member;

a polyurethane foam formed at least within the peripheral frame, wherein the foam is bonded to the peripheral frame; and a woven material disposed on only a first side of the polyurethane foam, wherein the woven material consists essentially of fiber stitch bonded together and selected from the group consisting of Fiberglass, Aramid, Carbon and Natural fibers.

* * * * *